US010696461B2

(12) United States Patent
Jones et al.

(10) Patent No.: US 10,696,461 B2
(45) Date of Patent: Jun. 30, 2020

(54) PACKAGING

(71) Applicant: Consolidated Graphics, Inc., Houston, TX (US)

(72) Inventors: Richard Scott Jones, Raleigh, NC (US); Adam Mitchell Geerts, Durham, NC (US); Craig Lowery Lombardi, Wake Forest, NC (US); Andrew Cunningham Charters, Raleigh, NC (US)

(73) Assignee: Consolidated Graphics, Inc., Hoston, TX (US)

( * ) Notice: Subject to any disclaimer, the term of this patent is extended or adjusted under 35 U.S.C. 154(b) by 0 days.

(21) Appl. No.: 16/356,781

(22) Filed: Mar. 18, 2019

(65) Prior Publication Data

US 2019/0210781 A1 Jul. 11, 2019

Related U.S. Application Data

(63) Continuation of application No. 15/631,247, filed on Jun. 23, 2017, now Pat. No. 10,336,522, which is a (Continued)

(51) Int. Cl.
*B65D 73/00* (2006.01)
*B65D 75/20* (2006.01)

(52) U.S. Cl.
CPC ..... *B65D 73/0078* (2013.01); *B65D 75/20* (2013.01)

(58) Field of Classification Search
CPC ..... B65D 73/0078; B65D 75/20
(Continued)

(56) References Cited

U.S. PATENT DOCUMENTS 883,662 A * 3/1908 McElree ..... B65D 27/16 229/80
2,614,737 A 10/1952 Parker
(Continued)

FOREIGN PATENT DOCUMENTS

FR 2 708 572 2/1995

*Primary Examiner* — Luan K Bui
(74) *Attorney, Agent, or Firm* — McCracken & Gillen LLC

(57) ABSTRACT

According to one aspect, a packaging includes a first panel including a first end and a second end, wherein first and second opposing perimeter side edges define the first panel and extend between the first end and the second end, and a first area having an inside surface is defined by the first end, the second end, and the perimeter side edges. A second panel includes a third end and a fourth end, wherein third and fourth opposing perimeter side edges define the second panel and extend between the third end and the fourth end, a second area having an inside surface is defined by the third end, the fourth end, and the perimeter side edges and wherein the second end is coupled to the third end at a first fold line. First and second tongues extend from third and fourth opposing perimeter side edges, respectively, at second and third fold lines, respectively. When the first panel is folded toward the second panel about the first fold line and the first and second tongues are folded about the second and third fold lines, respectively, the first and second tongues couple the first panel and the second panel. Further, the first end is coupled to the fourth end and the first area and the second area are free of fold lines and flaps.

20 Claims, 2 Drawing Sheets

Related U.S. Application Data continuation of application No. 13/922,781, filed on Jun. 20, 2013, now Pat. No. 9,701,455.

(58) Field of Classification Search
USPC ..... 206/39, 193, 424, 425, 449, 459.5, 461, 206/471, 806; 229/103.2
See application file for complete search history.

(56) References Cited

U.S. PATENT DOCUMENTS

| | | | | |
|---|---|---|---|---|
| 2,850,160 | A | 11/1956 | Siebel et al. | |
| 2,833,461 | A * | 5/1958 | Brom | B65D 27/22 229/313 |
| 3,089,590 | A | 9/1961 | Mell | |
| 3,124,299 | A * | 3/1964 | Stone et al. | B65D 5/2057 229/81 |
| 3,486,615 | A * | 12/1969 | De Woskin | B65B 11/52 229/125.35 |
| 3,963,121 | A | 6/1976 | Kipp | |
| 4,570,787 | A | 2/1986 | Forbes, Jr. | |
| 4,899,877 | A | 2/1990 | Kiernan | |
| 5,048,676 | A | 9/1991 | Borgis et al. | |
| 5,072,876 | A | 12/1991 | Wilson | |
| 5,379,894 | A | 1/1995 | Haas et al. | |
| 5,775,504 | A | 7/1998 | Menaged | |
| 5,842,567 | A | 12/1998 | Rowe et al. | |
| 5,947,297 | A | 9/1999 | Aoki et al. | |
| 6,012,580 | A | 1/2000 | Peters et al. | |
| 6,050,416 | A | 4/2000 | Blin et al. | |
| 7,143,892 | B2 | 12/2006 | Kolton et al. | |
| 2001/0022318 | A1 * | 9/2001 | Kaden | B65D 27/22 229/80 |
| 2006/0124495 | A1 | 6/2006 | David et al. | |
| 2013/0062342 | A1 | 3/2013 | Hansen et al. | |
| 2013/0220879 | A1 * | 8/2013 | Glass | B65D 27/00 206/767 |
| 2014/0103100 | A1 * | 4/2014 | Falcon | B65D 5/4204 229/103.2 |
| 2014/0231293 | A1 | 8/2014 | Nietvelt | |

* cited by examiner

PACKAGING

CROSS REFERENCE TO RELATED APPLICATIONS

The present application is a continuation of Jones et al., U.S. patent application Ser. No. 15/631,247, entitled PACKAGING and filed Jun. 23, 2017, which issued as U.S. Pat. No. 10,336,522 on Jul. 2, 2019; which in turn is a continuation of Jones et al., U.S. patent application Ser. No. 13/922,781, entitled PAPER SLEEVE PRODUCT and filed Jun. 20, 2013, which issued as U.S. Pat. No. 9,701,455 on Jul. 11, 2017. The entire contents of these applications and patents are incorporated herein by reference.

FIELD OF DISCLOSURE

This present invention relates to packaging utilized to display and protect products in a retail environment, and more particularly, to a one-piece integrated package for securing trading cards.

BACKGROUND

Traditionally, blister pack has been used to house collectible cards, gaming cards and similarly sized products for retail display. Such packaging generally includes a cavity or pocket created in a formable web and attached to a printable, rigid backing, such as paperboard. The formable web is most often petroleum-based, such as a thermoformed plastic and transparent, permitting the packaged product to be viewed while retained in the packaging. In practical use, the packaging promotes the brand and product, identifies package contents and manufacturer, and provides bar coding for retail point-of-sale transactions all while providing a safeguard against theft and product integrity. One drawback to such packaging is that it requires many steps to manufacture. The thermoformed plastic generally requires a machine that can unwind a plastic film or sheet, apply heat until the plastic is pliable, and urge the pliable plastic into negative molds under an applied pressure. Thereafter, the mold is cooled such that the plastic becomes rigid again and maintains its shape when removed from the mold. Following formation of the web, the product must then be inserted into the formed cavity, after which, a backing is glued, hot melted, stapled or otherwise secured to the web.

Another drawback to blister packaging is that the formable web is commonly a petroleum-based material such as polyvinyl chloride ("PVC"). While PVC is well known for its strength and resistance to liquids, chemicals, sunlight and weathering, it is not generally biodegradable or even degradable. As such, it would be desirable to provide packaging that is more environmentally friendly.

SUMMARY

According to one aspect, a packaging includes a first panel including a first end and a second end, wherein first and second opposing perimeter side edges define the first panel and extend between the first end and the second end, and a first area having an inside surface is defined by the first end, the second end, and the perimeter side edges. A second panel includes a third end and a fourth end, wherein third and fourth opposing perimeter side edges define the second panel and extend between the third end and the fourth end, a second area having an inside surface is defined by the third end, the fourth end, and the perimeter side edges and wherein the second end is coupled to the third end at a first fold line. First and second tongues extend from the third and fourth opposing perimeter side edges, respectively, at second and third fold lines, respectively. When the first panel is folded toward the second panel about the first fold line and the first and second tongues are folded about the second and third fold lines, respectively, the first and second tongues couple the first panel and the second panel. Further, a portion of the first area inside surface is directly coupled to a portion of the second area inside surface at a location proximate the first end and the fourth end and spaced from the first end the fourth end and the first area and the second area are free of fold lines and flaps.

According to another aspect, a packaging comprises a first panel including a first end and a second end, first and second opposing perimeter side edges defining the first panel and extending between the first end and the second end, wherein the second end and the perimeter side edges are free of fold lines and flaps. A second panel includes a third end and a fourth end, third and fourth opposing perimeter side edges defining the second panel and extending between the third end and the fourth end, wherein the second panel is free of fold lines and flaps, and wherein the second end is coupled to the third end at a first fold line and the first panel is substantially identical to the second panel. First and second tongues extend from the third and fourth opposing perimeter side edges, respectively, at second and third fold lines, respectively, wherein when the first panel is folded toward the second panel about the first fold line and the first and second tongues are folded about the second and third fold lines, respectively, the first and second tongues couple the first panel and the second panel. Also, a portion of the first panel spaced from the first end is coupled to a portion of the second panel spaced from the fourth end.

Other aspects and advantages will become apparent upon consideration of the following detailed description and the attached drawings wherein like numerals designate like structures throughout the specification.

DETAILED DESCRIPTION

Figure 1:
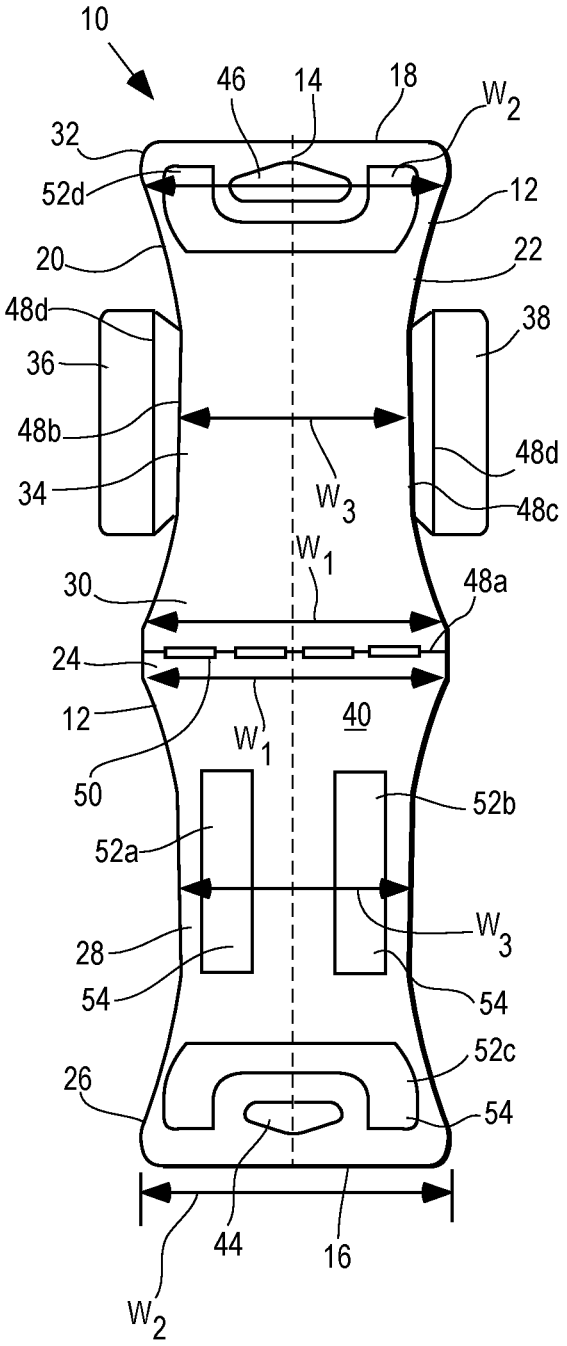
FIG. 1 is a front view of the panel of the display device of the invention.
Figure 2:
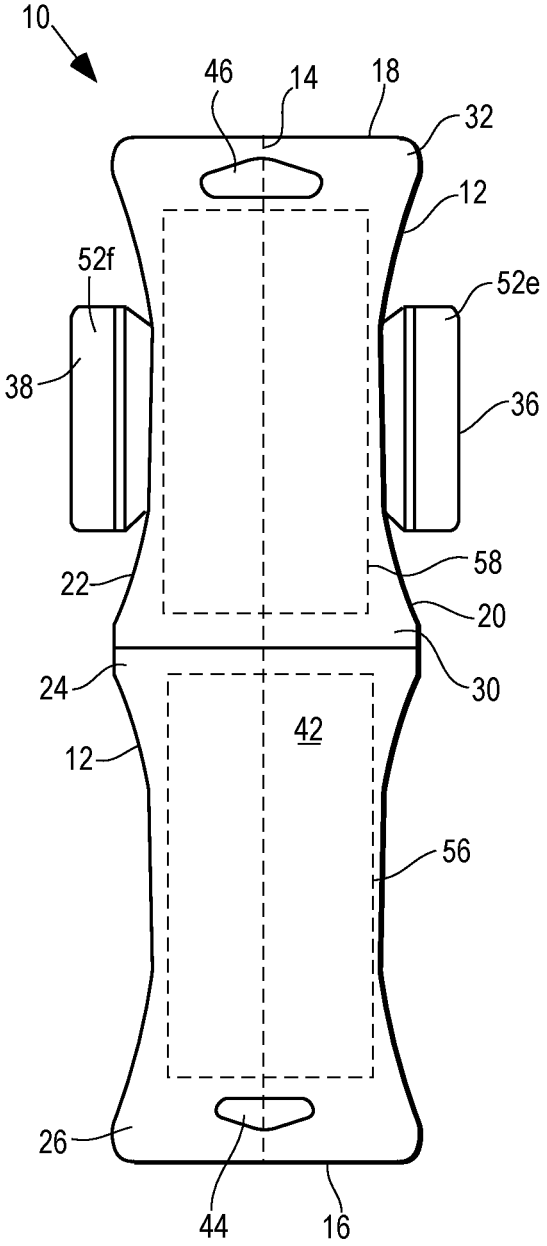
FIG. 2 is a back view of the panel of the display device of the invention.

Referring to FIGS. 1 and 2, a packaging or display device 10 of the invention is illustrated. Display device 10 is formed of a single, elongated panel 12 extending along a primary axis 14 between a first end 16 and a second end 18. Panel 12 is characterized by primary, opposing edges 20, 22 that extend generally perpendicular to the primary axis 14. The first end 16 includes a proximal end 24, a distal end 26 and a central portion 28 there between. Proximal end 24 has a first width W1, distal end 26 has a second width W2 and central portion 28 has a central width W3. Likewise, the second end 18 includes a proximal end 30, a distal end 32 and a central portion 34 there between. Proximal end 30 has a first width W1, distal end 32 has a second width W2 and central portion 34 has a central width W3.

In certain preferred embodiments, with respect to an end 16, 18, central width W3 is less than either first width W1 or second width W2 of that end, such that panel 12 at an end narrows between the respective distal and proximal ends. In certain preferred embodiments, edges 20, 22 are curved between the respective distal and proximal ends of and end 16, 18 so as to be concave in shape, the respective opposing concave edges forming a shape at that end 16, 18.

In certain embodiments, the first width W1 of each of the ends 16, 18 is the same. In certain embodiments, the second width W2 of each of the ends 16, 18 is the same. In certain embodiments, the central width W3 of each of the ends 16, 18 is the same. In certain embodiments, the first width W1 and the second width W2 of and end 16, 18 are the same.

A first tongue 36 and a second tongue 38 extend from the central portion 34 of second end 18 of panel 12. Preferably first and second tongues 36, 38 are perpendicular to central axis 14. Preferably, first tongue 36 extends from edge 20 and second tongue 38 extends from edge 22 so as to be substantially symmetrical about central axis 14.

FIG. 1 illustrates a first face 40 of panel 12, while FIG. 2 illustrates an opposing second face 42 of panel 12.

A first aperture 44 may be provided in panel 12 adjacent the first end 16 and a second aperture 46 may be provided in panel 12 adjacent the second end 18.

In certain embodiments, a crease, fold, pleat, furrow, hinge or similar mechanism 48 may be formed at desired points in panel 12 in order to bend various portions of panel 12 relative to one another. Persons of ordinary skill in the art will appreciate that mechanism 48 is integrally formed in panel 12 by various methods well known in the art. In this regard, such a hinge 48 is illustrated by a first hinge 48*a* formed adjacent the proximal ends 24, 30 of the first and second ends 16, 18 respectively. Hinge 48*a* extends between the panel edges 20 and 22. Hinge 48*a* is preferably substantially perpendicular to the primary axis 14 of the panel 12 so that first and second ends 16, 18 can be bent relative to one another during manufacture of display device 10.

Each of tongues 36, 38 may also be provided with a mechanism 48. As shown, first tongue 36 has a hinge 48*b* formed across tongue 36, extending preferably substantially parallel to the axis 14 of the panel 12. Hinge 48*b* is preferably formed at the intersection of tongue 36 and the edge 20 adjacent central portion 34 of second end 18. Similarly, second tongue 38 has a hinge 48*c* formed across tongue 38, extending preferably substantially parallel to the axis 14 of the panel 12. Hinge 48*c* is preferably formed at the intersection of tongue 38 and the edge 22 adjacent central portion 34 of second end 18. Hinges 48*b* and 48*c* permit tongues 36, 38 to be bent inward towards one another so that the back surfaces of tongues 36, 38 are exposed to the front surface of first end 16 of panel 12 as described in more detail below.

In certain preferred embodiments, an additional hinge 48*d* may be provided on each of tongues 36, 38. Each hinge 48*d* is spaced apart from the respective hinges 48*b*, 48*c*, preferably a distance selected to accommodate the thickness of the product (not shown) to be contained within display device 10.

In certain preferred embodiments, one or more slots 50, and preferably a plurality of spaced apart slots 50, are provided along mechanism 48 to enhance bending.

In certain preferred embodiments, first and second ends 16, 18 are substantially symmetrical in shape about hinge 48*a*.

A plurality of adhesion zones 52 are provided on panel 12. Adhesion zones 52 function as a point where two surfaces of panel 12 are joined together. In this regard, at least one, and preferably two of any two surfaces to be joined are provided with an adhesive, such as adhesive 54. With particular reference to FIG. 1, a plurality of adhesion zones 52 are provided on the first face 40 of panel 12. Specifically, first and second central adhesion zones 52*a*, 52*b* are provided on the front face 40 of the first end 16 the panel 12 adjacent the central portion 28. Each adhesion zone 52*a*, 52*b* is preferably spaced inwardly from the respective edge 20, 22. Likewise, end adhesion zones 52*c*, 52*d* may be provided adjacent the respective ends 16, 18. In one preferred embodiment, adhesion zones 52*c*, 52*d* may at least partially extent around apertures 44, 46, respectively.

With reference to FIG. 2, adhesion zones 52 are also provided on the second face 42 of panel 12. Specifically, first tongue 36 is provided with an adhesion zone 52*e* adjacent the outermost portion of tongue 36 and second tongue 38 is provided with an adhesion zone 52*f* adjacent the outermost portion of tongue 38.

Persons of ordinary skill in the art will appreciate that the number and position of adhesion zones 52 may differ without limiting certain embodiments of the invention. The number and position of adhesion zones is preferably selected, in conjunction with tongues 36, 38, to secure a product within display device 10.

Adhesive 54 may be any adhesive suitable for joining portions of panel 12 to one another as described herein. The particular type of adhesive is not intended as a limitation of the invention, but may include glue. Likewise, for purposes of the disclosure of the invention, adhesive 54 may be any other mechanism suitable for joining respective portions of panel 12 to one another, including a hook and loop mechanism or sliderless plastic zippers.

With ongoing reference to FIG. 2, the back face 42 of panel 12 may be provided with first print area 56 on first end 16 and a second print area 58 on second end 18. First and second print areas 56, 58 are oriented so as to face one another when displaying print or graphics thereon, thereby permitting panel 12 to be provided with print on only one face of the panel during manufacturing, but permitting the print to be properly oriented when the first and second ends 16, 18 are folded relative to one another at hinge 48*a*. For example, non-limiting print or graphics in first print area 56 may include identifying text or pictures for the product contained within packaging 10, while non-limiting print or graphics in the second print area 58 may include instructions or one or more bar codes for the product contained within packaging 10.

Figure 3:
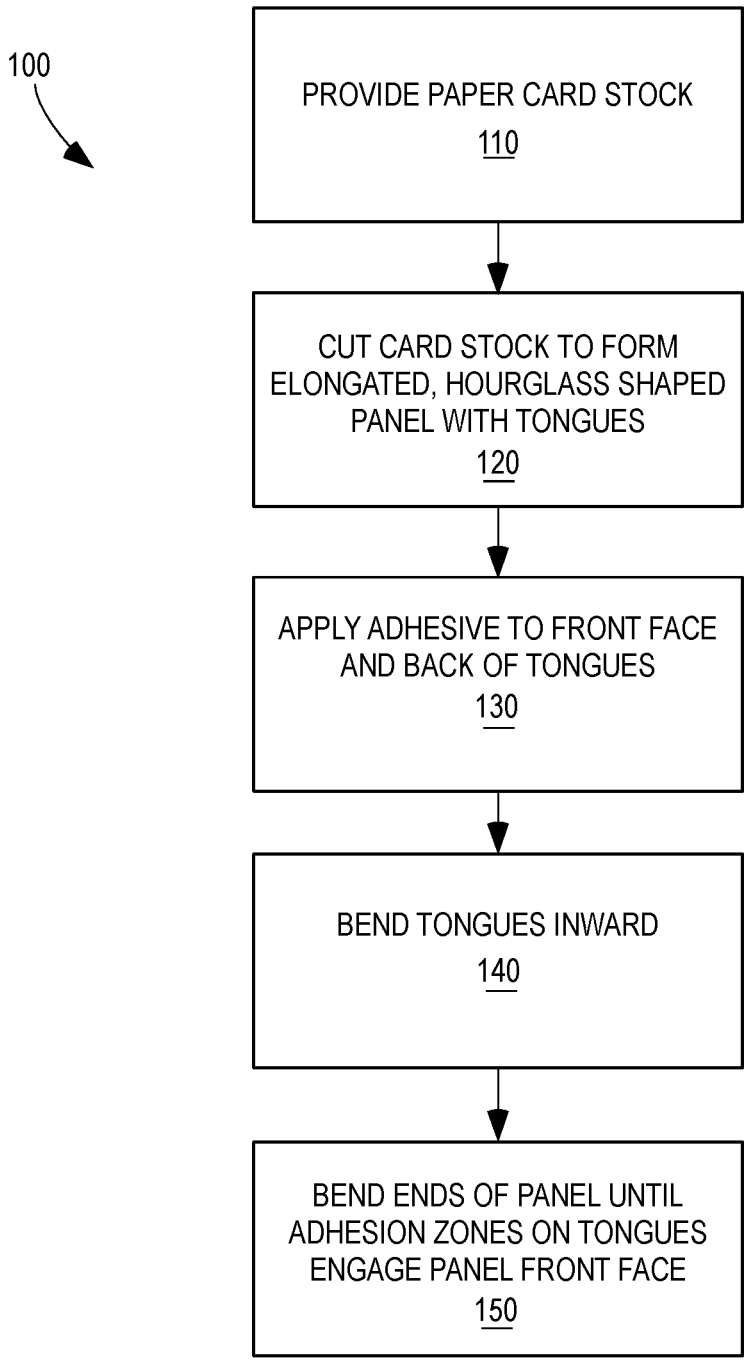
FIG. 3 is a flow-chart of a method of manufacturing the display device of the invention.

Turning to FIG. 3, with on-going reference to FIGS. 1 and 2, a flow-chart 100 describing the steps of manufacture of the display device is provided. In step 110, card stock is provided. The card stock may be standard paper card stock, preferably formed of recycled paper products. In step 120, the card stock is cut to form a panel having a general shape as described above for panel 12, namely a single, elongated panel having a front face and a back face, the panel extending along a primary axis between a first end and a second end, the panel having elongated, opposing primary edges, the first end characterized by a distal end having a distal width between opposing edges, a proximal end having a proximal width between opposing edges and a central portion having a central width between opposing edges, wherein the central width is less than the distal or proximal widths, the second end characterized by a distal end having a distal width between opposing edges, a proximal end having a proximal width between opposing edges and a central portion having a central width between opposing edges, wherein the central width is less than the distal or proximal widths, at least one, and preferably two tongues, each tongue extending from the central portion of the second end, the tongues being perpendicular to the central axis and extending from one of the edges and an adhesion zones on the front face of the first end of the panel adjacent the central portion of the first end and spaced inwardly from a panel edge. As described above, various other features may be cut or formed as part of step 120, such as cutting apertures 44,46 or slots 50. Likewise, hinges 48 may be formed as part of step 110.

In step 120, the panel 12 may be printed with print and/or graphics. Persons of ordinary skill in the art will appreciate that steps 110 and 120 may be altered so that step 120, namely printing, occurs before step 110, namely cutting as is common in the printing industry.

In step 130, adhesive is applied to one or more of the various adhesion zones. In certain embodiments, adhesive is applied to at least one of the adhesive zones of two surfaces two be joined together, while in another embodiment, adhesive is applied to the adhesive zones of both surfaces to be joined together. As described in certain embodiments above, to the extent another mechanism is utilized to secure two surfaces together, the mechanism can be secured to the respective adhesive zones. For example, with respect to two adhesive zones to be joined, a hook web may be secured to one adhesive zone and a loop web may be secured to the other adhesive zone. In certain embodiments, adhesive is applied to adhesion zones on the front face of the first and second ends of the cut panel, as well as to a portion of the adhesion zone on the back face of each tongue.

In step 140, each tongue is bent so that the tongue extends toward the central axis. Prior to or contemporaneously with the bending in step 140, a product may be positioned in the central portion of the second end of the panel, after which each tongue may be bent around the product.

In step 150, the first and second ends are bent relative to one another until the adhesion zone on the back face of the tongue engages the adhesion zone in the central portion of the front face of the first end of the panel. Pressure may be applied to the first and second ends to promote adhesion at the adjacent adhesion zones.

The display device as described herein provides more environmentally friendly packaging than traditional blister packaging. As such, the device is preferably formed of a paper material that is fully recyclable. The shape enhances gripping. The tongues serve the dual function of securing a product within the display device while also providing surfaces for securing the two ends of the display device together. The unitary design enhances a fully automated assembly of the packaging, while minimizing assembly steps and equipment over more traditional blister packaging utilizing a thermoform web. Finally, the packaging as described herein more securely protects the product disposed therein from damage based in part on the manner in which the package is folded around the product.

We claim:

1. A packaging, comprising:

a first panel including a first end and a second end, wherein first and second opposing perimeter side edges define the first panel and extend between the first end and the second end, and a first area having an inside surface is defined by the first end, the second end, and the perimeter side edges;

a second panel including a third end and a fourth end, wherein third and fourth opposing perimeter side edges define the second panel and extend between the third end and the fourth end, a second area having an inside surface is defined by the third end, the fourth end, and the perimeter side edges and wherein the second end is coupled to the third end at a first fold line; and first and second tongues extending from the third and fourth opposing perimeter side edges, respectively, at second and third fold lines, respectively, wherein when the first panel is folded toward the second panel about the first fold line and the first and second tongues are folded about the second and third fold lines, respectively, the first and second tongues couple the first panel and the second panel, and wherein a portion of the first area inside surface is directly coupled to a portion of the second area inside surface at a location proximate the first end and the fourth end and spaced from the first end and the fourth end;

wherein the first area and the second area are free of fold lines and flaps.

2. The packaging of claim 1, further including adhesive on one or more of the first tongue, the second tongue, and the first panel adapted to couple the first panel to the first tongue and the second tongue.

3. The packaging of claim 1, further including adhesive that couples the first area inside surface to the second area inside surface.

4. The packaging of claim 1, wherein the packaging is symmetric about a longitudinal axis of the packaging and asymmetric about a transverse axis of the packaging.

5. The packaging of claim 1, wherein when the first panel is folded toward the second panel about the first fold line and the first tongue and second tongue are folded about the second and third fold lines, the first tongue and the second tongue are disposed between the first panel and the second panel.

6. The packaging of claim 1, wherein the first panel defines a first aperture proximal the first end and the second panel defines a second aperture proximal the fourth end, and wherein when the first panel is folded about the first fold line toward the second panel, the first and second apertures at least partially align.

7. The packaging of claim 6, further including adhesive adjacent the first aperture adapted to couple the first area inside surface to the second area inside surface when the first panel is folded about the first fold line relative to the second panel.

8. The packaging of claim 1, wherein at least one of the first, second, third, and fourth opposing perimeter side edges is nonlinear.

9. The packaging of claim 1, where the first fold line includes spaced apart slots.

10. The packaging of claim 1, further including first adhesive on the first panel and second adhesive on the first panel, the first adhesive and the second adhesive being substantially symmetric about a longitudinal axis of the substrate, wherein the first adhesive is spaced apart from the second adhesive.

11. A packaging, comprising:

a first panel including a first end and a second end, first and second opposing perimeter side edges defining the first panel and extending between the first end and the second end, wherein the first end and the perimeter side edges are free of fold lines and flaps;

a second panel including a third end and a fourth end, third and fourth opposing perimeter side edges defining the second panel and extending between the third end and the fourth end, wherein the second panel is free of fold lines and flaps, and wherein the second end is coupled to the third end at a first fold line and the first panel is substantially identical to the second panel; and first and second tongues extending from the third and fourth opposing perimeter side edges, respectively, at second and third fold lines, respectively, wherein when the first panel is folded toward the second panel about the first fold line and the first and second tongues are folded about the second and third fold lines, respectively, the first and second tongues couple the first panel and the second panel, and wherein a portion of the first panel spaced from the first end is coupled to a portion of the second panel spaced from the fourth end.

12. The packaging of claim 11, further including adhesive on one or more of the first tongue, the second tongue, and the first panel adapted to couple the first panel to the first tongue and the second tongue.

13. The packaging of claim 11, further including adhesive that couples the portion of the first panel to the portion of the second panel.

14. The packaging of claim 13, wherein the substrate is symmetric about a longitudinal axis of the substrate and asymmetric about a transverse axis of the substrate.

15. The packaging of claim 14, wherein when the first panel is folded toward the second panel about the first fold line and the first tongue and second tongue are folded about the second and third fold lines, the first tongue and the second tongue are disposed between the first panel and the second panel.

16. The packaging of claim 15, wherein the first panel defines a first aperture proximate the first end and the second panel defines a second aperture proximate the fourth end, and wherein when the first panel is folded about the first fold line toward the second panel, the first and second apertures at least partially align.

17. The packaging of claim 16, further including adhesive adjacent the first aperture adapted to couple the portion of the first panel to the portion of the second panel when the first panel is folded about the first fold line relative to the second panel.

18. The packaging of claim 11, wherein at least one of the first, second, third, and fourth opposing perimeter side edges is nonlinear.

19. The packaging of claim 11, where the first fold line includes spaced apart slots.

20. The packaging of claim 11, further including first adhesive on the first panel and second adhesive on the first panel, the first adhesive and the second adhesive being substantially symmetric about a longitudinal axis of the substrate, wherein the first adhesive is spaced apart from the second adhesive.

* * * * *